US005544718A

United States Patent [19]

Schumacher

[11] Patent Number: 5,544,718

[45] Date of Patent: Aug. 13, 1996

[54] LADDER LIFT WITH SWIVEL TRAY

[76] Inventor: Lawrence H. Schumacher, 35647 Larkspur Dr., Wildomar, Calif. 92595

[21] Appl. No.: 414,915

[22] Filed: Mar. 31, 1995

[51] Int. Cl.[6] ..... E06C 7/00

[52] U.S. Cl. ..... 182/129; 182/141

[58] Field of Search ..... 182/129, 141, 182/204

[56] References Cited

U.S. PATENT DOCUMENTS

| | | | |
|---|---|---|---|
| 131,042 | 9/1872 | Wolf . | |
| 2,923,373 | 2/1960 | Ledgerwood . | |
| 3,269,682 | 8/1966 | Alpine | 182/129 |
| 3,490,558 | 1/1970 | Foley . | |
| 4,261,435 | 4/1981 | Winter . | |
| 4,418,793 | 12/1983 | Brent . | |
| 4,560,031 | 12/1985 | Dixon . | |

FOREIGN PATENT DOCUMENTS

| | | | |
|---|---|---|---|
| 680931 | 10/1952 | United Kingdom | 182/129 |
| 851279 | 1/1959 | United Kingdom . | |
| 2204906 | 11/1988 | United Kingdom | 182/129 |
| 2208887 | of 1989 | United Kingdom . | |

*Primary Examiner*—Alvin C. Chin-Shue

[57] ABSTRACT

A mechanical device that supports a variable height tray (20) which is removable or may be swiveled out of the way for storage. It is connected to the cross bar support (24) by it's tray arms (42) at the tray pivots (40) which protrude as studs from the cross bar support (24). The cross bar support (24) is attached to steel threaded shafts (26) with shaft nuts (22). The shafts (26) are inserted into the retraction tubes (38) that provide support. Engagement windows (30) allow the spring loaded clamps (32) to engage against the threaded edges of the shafts (26) thus allowing them to lock into place at the desired height. The spring loaded clamps (32) are attached to the retraction tubes (38) with pipe clamps (34) and their leverage ends are tied together in tandem fashion with a release bar (36) that permits simultaneous operation. The entire mechanism is mounted to a step ladder with screws and standard electro mechanical tubing clamps.

1 Claim, 3 Drawing Sheets

LADDER LIFT WITH SWIVEL TRAY

CROSS TO RELATED CASES

None.

BACKGROUND—FIELD OF INVENTION

This invention relates to ladders, specifically to a variable height work platform that can be attached to a ladder.

BACKGROUND—DESCRIPTION OF PRIOR ART

The necessity to provide a variable height work surface for the support of parts, tools and construction material in the construction and maintenance of commercial and industrial buildings has led to creation of very large, cumbersome and awkward ladders such as the "Dixon" device (U.S. Pat. No. 4,560,031, Dec. 24, 1985) and the "Foley" device (U.S. Pat. No. 3,490,558, Jan. 20, 1970). The majority of these devices are of such design that they are of little use to the the average general or subcontractor, let alone the general public, in the residential sector. They are not easily transportable and are usually kept on site as a permanent building fixture.

The portability problem of a ladder with a variable height platform has been partially solved by the "Brent" device (U.S. Pat. No. 4,418,793, Dec. 6, 1983) by mounting a smaller, variable height platform to the side of a typical step ladder. Although this design solved one problem, it created several disadvantages that make using this device unsafe when it is used for supporting building materials of moderate weight.

It also puts the operator in an unbalanced position by requiring him to lean to one side when adjusting the height of the material it is supporting. Although this invention provides an adequate platform for holding tools and small parts, it is inadequate for the use of supporting heavier loads and creates a potential for disaster should the operator step off the ladder. Since this device is side mounted, instead of centrally mounted, the ladder has a propensity to tip over.

Further objects and advantages of my invention will become apparent from a consideration of the drawings and ensuing description.

OBJECTS AND ADVANTAGES

The device I have invented has resolved the above mentioned problems and has several advantages over the Brent invention. By being centrally mounted on the ladder and by having two support rods, it keeps the supported work material balanced directly over the top of the ladder. Stepping off the ladder while the platform is supporting a work load does not create a potential for the ladder to tip over. It is easier to operate since it can be raised to any height without activating a release lever or by leaning to one side to activate such a device.

Portability has also been improved because the work platform can be swiveled over the top of the ladder and stored against the ladder steps, thus creating a more compact ladder and eliminating the need to remove the platform when storing the ladder on its' side.

LIST OF REFERENCE NUMERALS

| Numeral | Description |
|---|---|
| 20 | Tray. |
| 22 | Shaft nut. |
| 24 | Cross bar support. |
| 26 | Threaded shaft. |
| 28 | Retraction tube. |
| 30 | Engagement window. |
| 32 | Spring loaded clamp. |
| 34 | Pipe clamp. |
| 36 | Release bar. |
| 38 | Retraction tube mounting hole. |
| 40 | Tray pivot. |
| 42 | Tray arm. |

DRAWING FIGURES

DESCRIPTION—FIGS. 1–4 (Parts 20–42)

Figure 1:
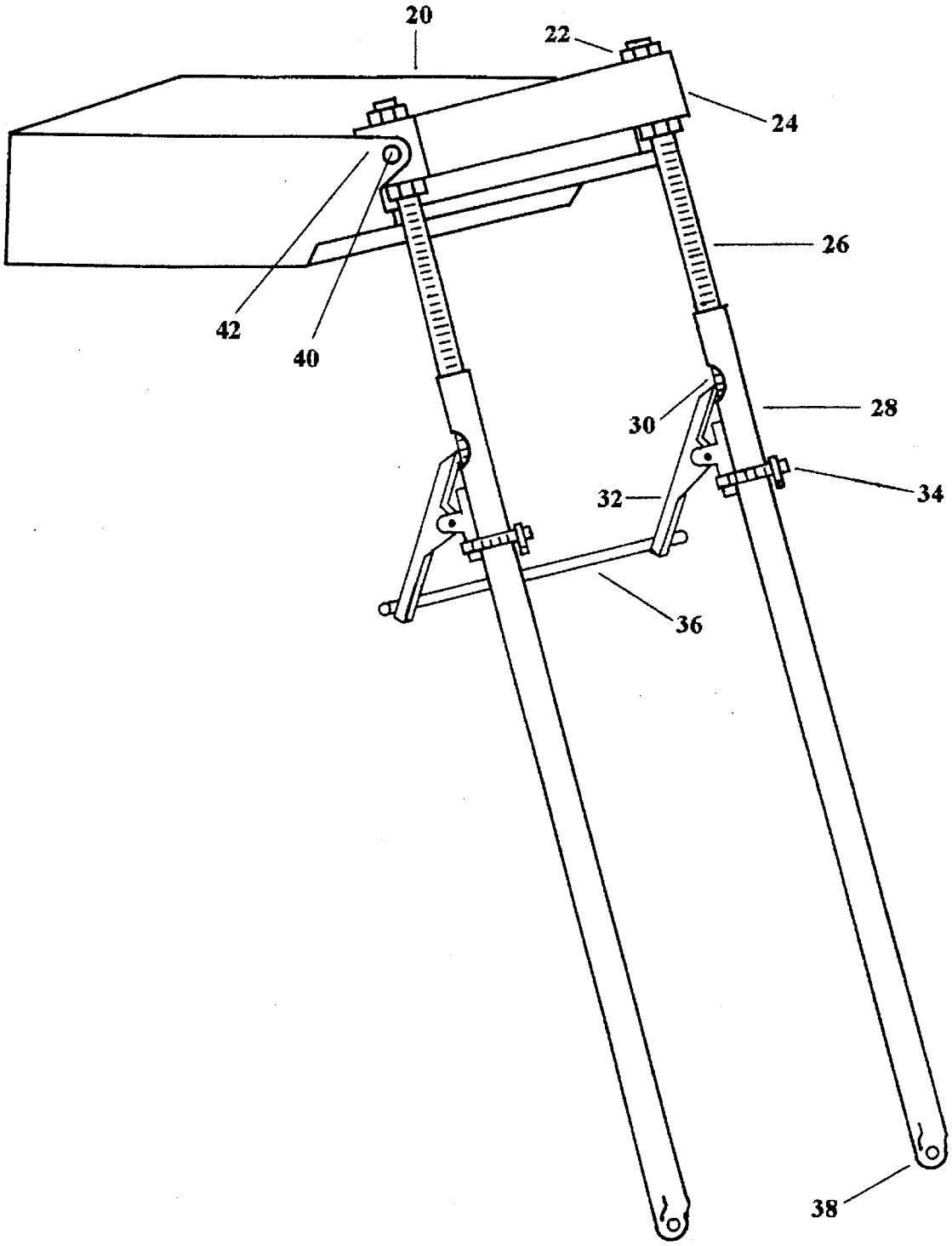
FIG. 1 shows a perspective view of the main embodiment of the ladder lifting accessory.

FIG. 1 shows a perspective view of my invention.

It consists of a tray 20 made of metal or plastic that is connected at the tray pivots 40 which are located at each end of the cross bar support 24. The tray pivots 40 consist of tabs that extend out of the ends of the cross bar support 24 through holes in the tray arms 42.

A cross bar support 24 made of metal or plastic that is fastened to the ends of each threaded shaft 26 with shaft nuts 22. Each shaft 26 is inserted into a retraction tube 28 made of ½ inch electro-mechanical tubing.

On each retraction tube 28 an engagement window 30 is provided to allow the end of each spring loaded clamp 32 to come in contact with the threaded shafts 26 in order to provide a break point after adjustment of the tray 20 to the desired height.

A pipe clamp 34 is used to secure each spring loaded clamp 32 to each retraction tube 28.

A release bar 36 is attached to the end of each spring loaded clamp 32 with rivets or screws to permit tandem operation of the spring loaded clamps 32.

A retraction tube mounting hole 38 is provided at the crimped end of each retraction tube 28 for the purpose of mounting the device to a ladder.

Figure 2:
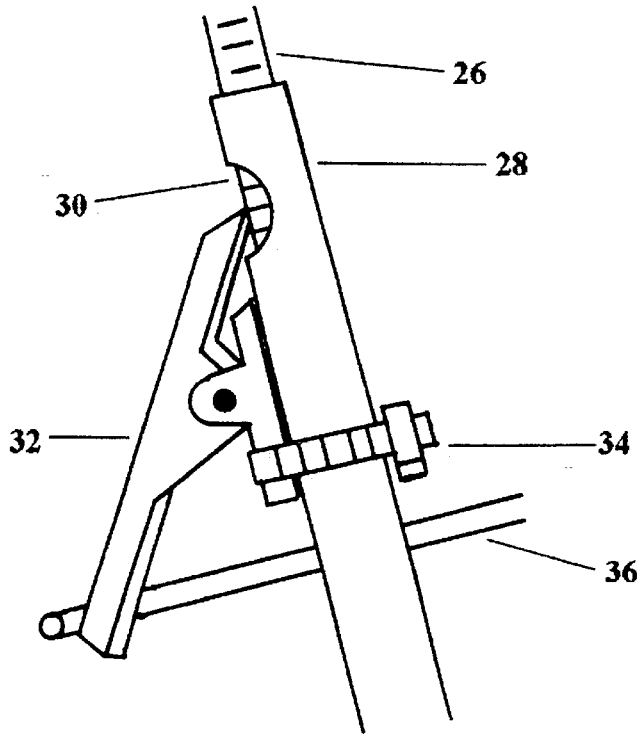
FIG. 2 shows a closer view of the spring loaded clamp.

FIG. 2 shows a closer view of the spring loaded clamp 32 attached to the retraction tube 28 with the pipe clamp 34. This view gives a better understanding of how the spring loaded clamp 32 engages against the threaded shaft 26 through the engagement window 30. Note that one of the jaws of the spring loaded clamp 32 has been removed to allow the opposing jaw to make contact with the threaded shaft 26.

Figure 3:
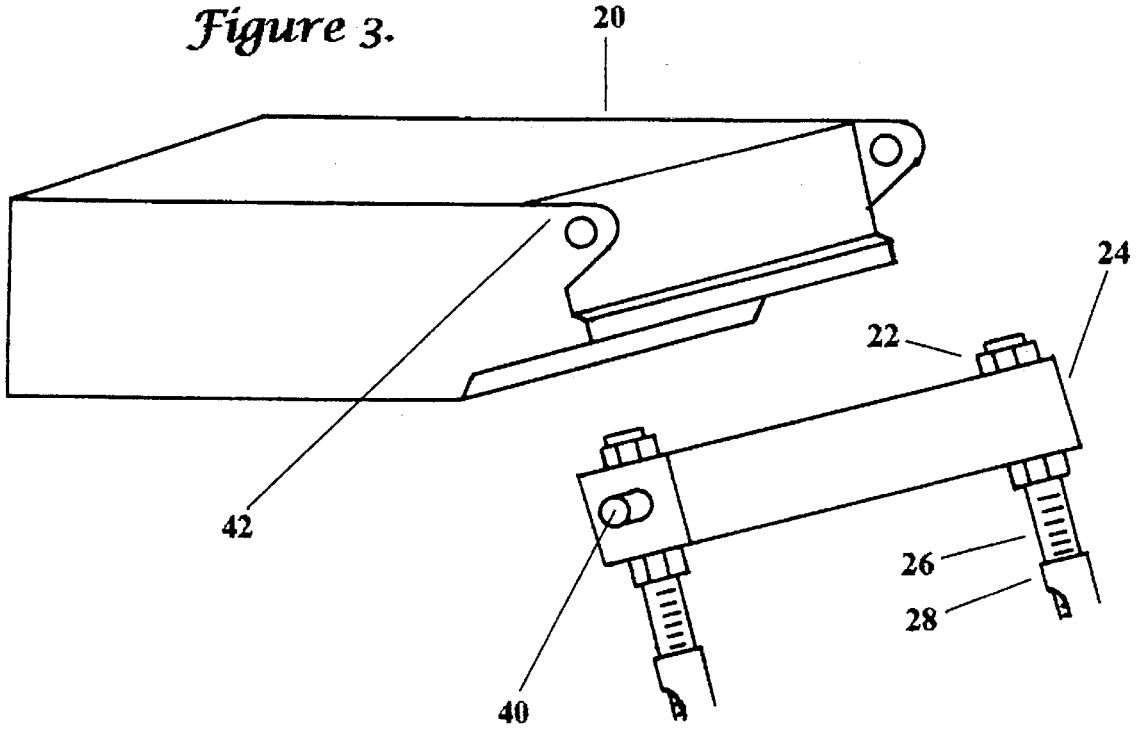
FIG. 3 shows a closer view of the tray removed from the cross bar support.

FIG. 3 shows the tray 20 removed from the cross bar support 24. This view lends a better understanding of how the tray arms 42 attach to the tray pivots 40.

Figure 4:
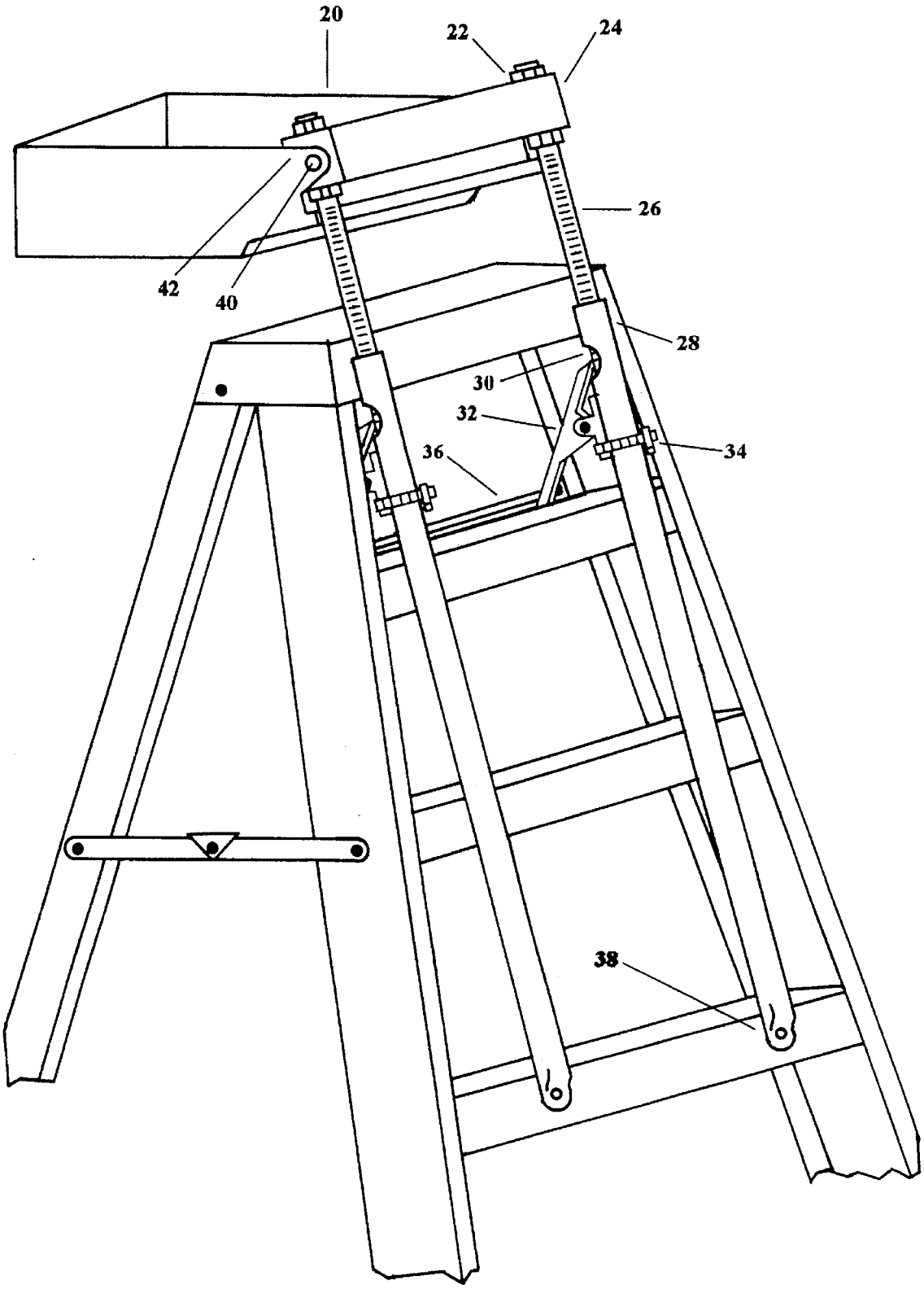
FIG. 4 shows the ladder lifting accessory attached to a step ladder using sheet metal screws at the base of each retraction tube and electro-mechanical tubing clamps at the top of each tube.

FIG. 4 shows my invention attached to a standard "A" frame type step ladder for which it was designed.

OPERATION—FIG. 1 (20–42)

After this ladder accessory is attached to a typical folding step ladder, it is operated by standing on the first step of the ladder and flipping the tray 20 over the top of the ladder. By grasping the underside of the cross bar support 24 and sliding it upward, the tray 20 can be raised to any desired height within its' range of operation. The spring loaded clamps 32 act as ratchets, allowing motion only in the upward direction and automatically hold the threaded shafts 26 in place by applying constant pressure against the threads.

To retract the tray 20 to a lower height or to the original storage position, the release bar 36 is grasped with one hand and pulled toward the operator while holding the underside of the cross bar support 24 with the other hand and lowering it to the desired height.

The tray 20 may be removed should the operator wish not to use it or, if he is a painter, to clean the tray after use. This is accomplished by flexing the tray arms 42 in an outward direction and sliding the tray 20 off the ends of the cross bar support 24.

CONCLUSION, RAMIFICATIONS AND SCOPE

After review, it should be apparent to the reader that the ladder lift accessory has many advantages over previous inventions. It is easier and safer to operate and is more compact which makes it much easier to transport. It suits a wider variety of trade uses as well as provides a broader usefulness for the general public who would find it appeasing for their home improvement and maintenance needs.

Additional advantages are:

It is centrally mounted on the ladder, thus making access to parts, tools, etc. easier by placing them directly in front of the worker at the desired work height.

It keeps the worker balanced in the center of the ladder thus reducing the likelihood of tipping the ladder over.

It can be raised with one hand which allows the user to keep the other hand on the ladder for balance and will automatically lock into place when set to the desired height.

If the user wishes to use the device only as a variable height support he can do so by removing the parts tray and storing it away, thus making the ladder lift device even lighter and less cumbersome.

It frees up additional time for the user by eliminating unnecessary trips up and down the ladder for needed parts, tools and paint, since all can be loaded into the parts tray and thus be readily available for use.

It provides an emergency hand hold, when extended, should the user have a momentary loss of balance.

I claim:

1. A ladder mounted lifting accessory, comprising:

a. two vertically parallel tubes into each a threaded shaft of smaller diameter and of greater length than said tubes is inserted to provide a sliding and support means and b. a cross member bored at each end vertically through its' thickness to allow the upper most end of said rods shafts to be inserted and secured to by a bolting means and c. cylindrical protrusions at each end of said cross member extending outwardly and parallel with said cross member's length and d. a horizontal platform comprising a main body and vertical sides with two of said sides being of extended length from the main body and parallel to one another and having openings of the same size of said cylindrical protrusions to provide a mounting means to said cross member thus permitting radial motion and removal of said platform and e. spring loaded clamps, each having a leverage and clamping ends, attached to said tubes on their undersides by a pipe clamp means allowing the clamping ends of said spring loaded clamps to engage against said shafts' threaded surface through an opening on the underside of said tubes to permit securing of said tubes at infinitely variable heights and f. a release bar means suspended horizontally across the distance between said spring loaded clamps and attached to the leverage ends of said spring loaded clamps by a bolting means whereby said clamps can be disengaged from said threaded shafts simultaneously to permit said threaded shafts to slide freely within said parallel tubes.

* * * * *

UNITED STATES PATENT AND TRADEMARK OFFICE

CERTIFICATE OF CORRECTION

PATENT NO. : 5,544,718

DATED : August 13, 1996

INVENTOR(S) : Lawrence H. Schumacher

It is certified that error appears in the above-indentified patent and that said Letters Patent is hereby corrected as shown below:

Column 4:

In the claim, at lines 16/17 in paragraph B, between the words "said" and "shafts", the word "rods" needs to be removed.

Signed and Sealed this

Twenty-first Day of January, 1997

*Attest:*

*Attesting Officer*

BRUCE LEHMAN

*Commissioner of Patents and Trademarks*